US007146121B2

(12) United States Patent
Horinoe et al.

(10) Patent No.: US 7,146,121 B2
(45) Date of Patent: Dec. 5, 2006

(54) PROCESS UNIT, PHOTOCONDUCTIVE UNIT, DEVELOPING UNIT, AND IMAGE FORMING APPARATUS

(75) Inventors: Mitsuru Horinoe, Chita-gun (JP); Masahiro Ishii, Nagoya (JP); Isao Kishi, Nagoya (JP); Takeshi Fuwazaki, Nagoya (JP); Satoru Ishikawa, Nishikasugai-gun (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 119 days.

(21) Appl. No.: 10/958,262

(22) Filed: Oct. 6, 2004

(65) Prior Publication Data

US 2005/0100363 A1 May 12, 2005

(30) Foreign Application Priority Data

Oct. 7, 2003 (JP) ..... 2003-348272

(51) Int. Cl.
*G03G 21/16* (2006.01)

(52) U.S. Cl. ..... 399/111; 399/119

(58) Field of Classification Search ..... 399/107, 399/111, 116, 119

See application file for complete search history.

(56) References Cited

U.S. PATENT DOCUMENTS

| | | | | |
|---|---|---|---|---|
| 4,989,037 | A * | 1/1991 | Nagatsuna | 399/167 |
| 5,089,849 | A * | 2/1992 | Hiraoka | 399/119 |
| 5,442,421 | A * | 8/1995 | Kojima | 399/112 |
| 5,581,328 | A * | 12/1996 | Yashiro | 399/111 |
| 5,708,922 | A * | 1/1998 | Azuma et al. | 399/111 |
| 6,041,203 | A * | 3/2000 | Suzuki et al. | 399/111 |
| 6,088,555 | A | 7/2000 | Mizuno | |
| 6,128,452 | A | 10/2000 | Miyabe et al. | |
| 6,463,242 | B1 * | 10/2002 | Kojima et al. | 399/258 |
| 6,493,527 | B1 * | 12/2002 | Higeta et al. | 399/111 |
| 2003/0053819 | A1 * | 3/2003 | Nomura et al. | 399/110 |
| 2004/0022556 | A1 * | 2/2004 | Nomura | 399/116 |
| 2004/0062566 | A1 * | 4/2004 | Kato et al. | 399/110 |
| 2004/0190932 | A1 * | 9/2004 | Ishii | 399/110 |
| 2004/0190938 | A1 * | 9/2004 | Horinoe et al. | 399/119 |
| 2006/0056878 | A1 * | 3/2006 | Okabe et al. | 399/119 |

FOREIGN PATENT DOCUMENTS

| | | | |
|---|---|---|---|
| DE | 3244515 | A1 | 6/1984 |
| EP | 0 572 048 | A1 | 12/1993 |
| EP | 1 273 980 | A2 | 1/2003 |
| EP | 1 462 866 | A1 | 9/2004 |
| EP | 1 462 870 | A1 | 9/2004 |
| JP | A 7-72782 | | 3/1995 |

* cited by examiner

*Primary Examiner*—David M. Gray
*Assistant Examiner*—Ryan D. Walsh
(74) *Attorney, Agent, or Firm*—Oliff & Berridge, PLC

(57) ABSTRACT

An image forming apparatus includes: an image carrier that carries an electrostatic latent image thereon; an electrostatic latent image forming unit that forms an electrostatic latent image on a surface of the image carrier; a developing unit having a toner hopper that receives toner, and a contact portion that contacts with a surface of the image carrier, the contact portion being provided to be displaceable relatively along the surface of the image carrier so as to transfer the toner received in the toner hopper to the electrostatic latent image formed by the electrostatic latent image forming unit; and a guide mechanism that supports the developing unit to be displaceable in a predetermined direction so as to bring the contact portion of the developing unit into contact with an upper portion of the image carrier due to a weight of the developing unit.

21 Claims, 6 Drawing Sheets

PROCESS UNIT, PHOTOCONDUCTIVE UNIT, DEVELOPING UNIT, AND IMAGE FORMING APPARATUS

BACKGROUND OF THE INVENTION

1. Field of the Invention

The present invention relates to image forming apparatus such as a laser printer.

2. Description of the Related Art

In a conventional image forming apparatus such as a laser printer, a desired electrostatic latent image is formed on the surface of an image carrier such as a photoconductor drum. Next, to the image carrier surface where the electrostatic latent image is formed, toner is transferred to form a toner image by a developing unit. The formed toner image is transferred onto a recording sheet. Thus, an image is formed.

Examples of methods for transferring a toner image onto a recording sheet include a method in which a toner image is transferred directly to a recording sheet conveyed through a transfer belt, and a method in which a toner image is once transferred onto a transfer belt (generally referred to as "intermediate transfer belt") so as to form an image on the intermediate transfer belt, and then the image is secondarily transferred onto a recording sheet.

In order to obtain a stable and good image quality, it is important to transfer the toner uniformly from the developing unit to the image carrier surface in such a series of steps of image formation.

To this end, in the image forming apparatus in the background art, pressure is applied between the developing unit and the image carrier, and a pressure mechanism using a spring or the like is provided for keeping the pressure constant. (e.g. see JP-A-7-072782)

SUMMARY OF THE INVENTION

However, in addition to the spring for pressing the developing unit onto the image carrier, the aforementioned pressure mechanism also needs a pressure release mechanism or the like for releasing the pressure when the toner or the photoconductor drum is replaced. This makes the structure of the pressure mechanism complex. For this reason, the pressure mechanism is a factor in impeding miniaturization of the developing unit and hence miniaturization of the image forming apparatus.

The present invention was developed in consideration of such a problem. It is therefore one of objects of the invention to remove a pressure mechanism to thereby miniaturize image forming apparatus and extend the life thereof.

According to a first aspect of the invention, there is provided an image forming apparatus including: an image carrier that carries an electrostatic latent image thereon; an electrostatic latent image forming unit that forms an electrostatic latent image on a surface of the image carrier; a developing unit having a toner hopper that receives toner, and a contact portion that contacts with a surface of the image carrier, the contact portion being provided to be displaceable relatively along the surface of the image carrier so as to transfer the toner received in the toner hopper to the electrostatic latent image formed by the electrostatic latent image forming unit to form a toner image that is to be transferred to a transfer material so as to form an image on the transfer material; and a guide mechanism that supports the developing unit to be displaceable in a predetermined direction so as to bring the contact portion of the developing unit into contact with an upper portion of the image carrier due to a weight of the developing unit.

According to a second aspect of the invention, there is provided a developing unit including: a developer casing having a pair of side plates that oppose with each other and receives developer therein; a developing roller that carries the developer and supplies the developer to an image carrier, the developing roller being rotatably supported by an axis thereof that is supported by the side plates; and at least two protrusions being protruded from the side plates, at least one of the two protrusions is provided on an extensional line that passes an abutting portion where the developing roller and the image carrier abut with each other, and a rotational axis of the axis that supports the developing roller.

According to a third aspect of the invention, there is provided a photoconductor unit including: a photoconductor drum casing having a pair of side plates that rotatably support a image carrier, the photoconductor drum casing to which a developing unit having a developing roller is detachably attached; and at least two guides formed by notching the side plates partially into a U-shape, at least one of the two guides is provided on an extensional line that passes an abutting portion where the developing roller and the image carrier abut with each other, and a rotational axis of the axis that supports the developing roller.

According to a fourth aspect of the invention, there is provided a process unit including: a developing unit that includes: a developer casing having a pair of side plates that oppose with each other and receives developer therein; a developing roller that carries the developer and supplies the developer to an image carrier, the developing roller being rotatably supported by an axis thereof that is supported by the side plates; and at least two protrusions being protruded from the side plates; and a photoconductor unit that includes: a photoconductor drum casing having a pair of side plates that rotatably support a image carrier, the photoconductor drum casing to which a developing unit having a developing roller is detachably attached; and at least two guides formed by notching the side plates partially into a U-shape, the guides respectively supporting the protrusions, wherein at least one of the two protrusions and the respective one of the two guides are provided on an extensional line that passes an abutting portion where the developing roller and the image carrier abut with each other, and a rotational axis of the axis that supports the developing roller.

BRIEF DESCRIPTION OF THE DRAWINGS

These and other objects and advantages of the present invention will become more fully apparent from the following detailed description taken with the accompanying drawings, in which.

DETAILED DESCRIPTION OF THE PREFERRED EMBODIMENTS

Referring now to the accompanying drawings, a description will be given in detail of preferred embodiments of the invention.

Figure 1:
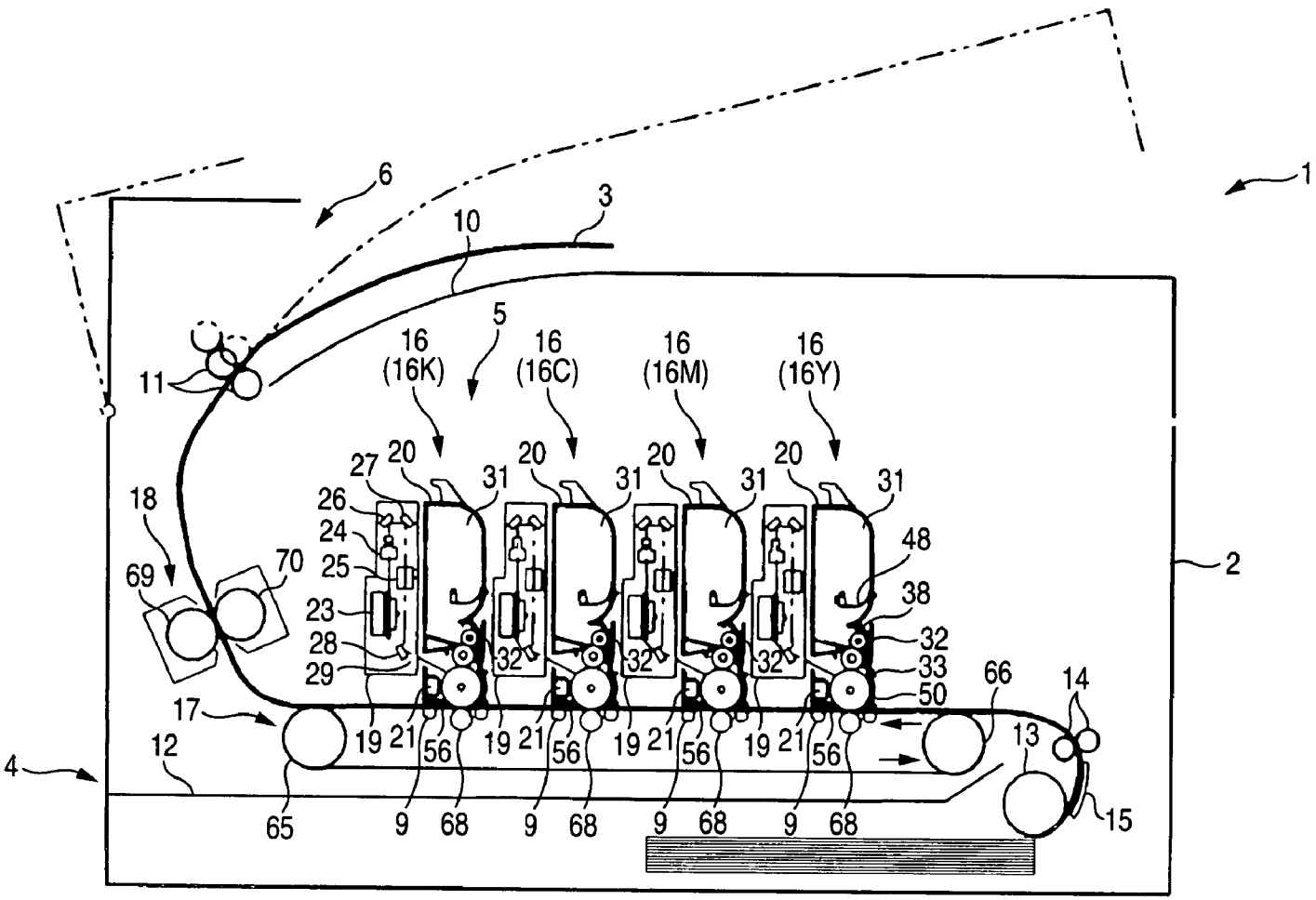
FIG. 1 is a sectional view showing the schematic configuration of a color laser printer according to an embodiment.

FIG. 1 is a sectional view showing the schematic configuration of a color laser printer 1 according to a first embodiment to which the invention is applied.

In FIG. 1, the color laser printer 1 is a so-called vertical tandem-type color laser printer in which four image forming units 16 which will be described later are disposed horizontally in parallel. The color laser printer 1 includes a body casing 2, a sheet feeding portion 4 for feeding a recording sheet 3 as a transfer material, an image formation portion 5 for forming an image on the recording sheet 3 fed thereto, and a sheet ejection portion 6 for ejecting the recording sheet 3 in which the image has been formed. The sheet feeding portion 4, the image formation portion 5 and the sheet ejection portion 6 are provided in the body casing 2.

The sheet feeding portion 4 has a sheet feeding tray 12, a sheet feeding roller 13 and conveyance rollers 14 in a bottom portion of the sheet feeding portion 4 inside the body casing 2. The sheet feeding tray 12 is removably attached to the body casing 2 from a front side of the body casing 2. The sheet feeding roller 13 is provided above one end portion (above the front side) of the sheet feeding tray 12. The conveyance rollers 14 are located above the sheet feeding roller 13 and provided on the downstream side in the conveyance direction of the recording sheet 3 with respect to the sheet feeding roller 13 (hereinafter the downstream side in the conveyance direction of the recording sheet 3 will be occasionally abbreviated to "downstream side", and the upstream side in the conveyance direction of the recording sheet 3 will be occasionally abbreviated to "upstream side").

Recording sheets 3 are stacked in the sheet feeding tray 12. The uppermost one of the recording sheets 3 is fed toward the conveyance rollers 14 one by one in accordance with the rotation of the sheet feeding roller 13, and sent in turn from the conveyance rollers 14 to a transfer position between a conveyance belt 67 and photoconductor drums 56.

A guide member 15 is provided between the sheet feeding roller 13 and the conveyance rollers 14 so as to be disposed in the up/down direction. The recording sheets 3 fed by the sheet feeding roller 13 are sent in turn to the transfer position between the conveyance belt 67 and the photoconductor drums 56 by the guide member 15.

Each image forming unit 16 functions as an image forming unit according to the invention. Each image forming unit 16 includes a photoconductor unit 9 having a photoconductor drum 56 supported as an image carrier rotatably, a charger 21 for charging the photoconductor drum 56, a scanner unit 19 serving as an electrostatic latent image forming unit for forming an electrostatic latent image on the photoconductor drum 56, and a developing unit 20 serving as a developing unit for transferring toner (developer) to the photoconductor drum 56 to thereby form a toner image thereon. The charger 21, the scanner unit 19 and the developing unit 20 are disposed around the photoconductor drum 56.

The photoconductor drum 56 is a hollow drum in which an organic photoconductor containing a positively chargeable material such as positively chargeable polycarbonate as its chief component is laminated to the outer circumferential surface of a cylindrical sleeve of aluminum so as to form a photoconductive layer. The photoconductor drum 56 is rotatably supported on the photoconductor unit 9 in the state where the cylindrical sleeve has been grounded. The photoconductor drum 56 may be configured to be rotatably supported on the body casing 2, instead of on the photoconductor unit 9.

For example, the charger 21 is a positively charging Scorotron type charger for generating corona discharge from a charging wire made from tungsten or the like so as to charge the surface of the photoconductor drum 56 uniformly as an anode.

The scanner unit 19 is constituted by a laser generator (not shown) for generating a laser beam for forming an electrostatic latent image in the surface of the photoconductor drum 56, a polygon mirror 23, a pair of lenses 24 and 25, and three reflecting mirrors 26, 27 and 28. Those constituent members of the scanner unit 19 are received in a scanner casing 22 as a housing.

In the scanner unit 19, a laser beam (shown by the chain line in FIG. 1) emitted from the laser emitting portion is reflected by the polygon mirror 23, sequentially transmitted through or reflected by the lens 24, the reflecting mirror 26, the reflecting mirror 27, the lens 25 and the reflecting mirror 28, and shot out from a shooting window 29. The photoconductor drum 56 is scanned and irradiated with the laser beam shot out from the shooting window 29. Thus, an electrostatic latent image is formed in the surface of the photoconductor drum 56.

The developing unit 20 has a toner hopper 31 as a toner receiving portion, a feed roller 32 as a toner feed unit, and a developing roller 33 as a toner carrier. Those constituent members of the developing unit 20 are received in a developer casing 43.

The toner hopper 31 is formed as an internal space of the developer casing 43. In the toner hopper 31, an agitator 48 is provided on the side-close to the developing roller 33, and toner of yellow (Y), magenta (M), cyan (C) or black (K) is received correspondingly to each image forming unit 16.

That is, the aforementioned four image forming units 16 include an image forming unit 16Y in which toner of yellow (Y) is received in its toner hopper 31, an image forming unit 16M in which toner of magenta (M) is received in its toner hopper 31, an image forming unit 16C in which toner of cyan (C) is received in its toner hopper 31, and an image forming unit 16K in which toner of black (K) is received in its toner hopper 31.

The toner received in each toner hopper 31 is a positively chargeable nonmagnetic monocomponent developer, which is manufactured by suspension polymerization or emulsion polymerization, and which is substantially spherical to have extremely high flowability.

The feed roller 32 is disposed under the toner hopper 31. The feed roller 32 includes a roller portion made from a conductive sponge member, and a roller shaft made from metal and coated with the roller portion. The feed roller 32 is rotatably supported in a nip portion where the feed roller 32 faces the developing roller 33 while making contact with the developing roller 33, so that the feed roller 32 can rotate in the opposite direction to the developing roller 33.

The developing roller 33 is rotatably disposed under the feed roller 32 and in a position where the developing roller 33 faces the feed roller 32 while making contact with the feed roller 32. The developing roller 33 formed includes a roller portion made from an elastic member such as a conductive rubber material, and a roller shaft made from metal and coated with the roller portion.

The transfer portion 17 is disposed inside the body casing 2 so as to face the photoconductor drums 56 on the opposite side to the developing units 20. The transfer portion 17 has a driving roller 65, a driven roller 66, a conveyance belt 67 which is an endless belt, and transfer rollers 68.

The driven roller 66 is disposed in front of the photoconductor drum 56 of the image forming unit 16Y on the most upstream side in the conveyance direction of the recording sheet 3, and above and at the rear of the sheet feeding roller 13. On the other hand, the driving roller 65 is disposed at the rear of the photoconductor drum 56 of the black image forming unit 16K on the most downstream side in the conveyance direction of the recording sheet 3, and under and obliquely in front of a fixation portion 18.

The conveyance belt 67 is made of conductive resin such as polycarbonate or polyimide having conductive particulates such as carbon dispersed therein. The conveyance belt 67 is wound between the driving roller 65 and the driven roller 66. The conveyance belt 67 is disposed so that the outer surface of the wound conveyance belt 67 faces all the photoconductor drums 56 of the image forming units 16 while making contact with all the photoconductor drums 56.

In accordance with driving of the driving roller 65, the driven roller 66 is driven so that the conveyance belt 67 orbits counterclockwise between the driving roller 65 and the driven roller 66 so as to rotate in the same direction as the photoconductor drums 56 in the contact surface facing the photoconductor drums 56 of the image forming units 16 while making contact with the photoconductor drums 56.

Each transfer roller 68 is disposed on the inner side of the conveyance belt 67 that is wound therearound so as to face the photoconductor drum 56 of the corresponding image forming unit 16 through the conveyance belt 67. The transfer roller 68 formed has a roller portion made from an elastic member such as a conductive rubber material, and a roller shaft made from metal is coated with the roller portion.

The transfer roller 68 is provided to be rotatable in counterclockwise direction so as to rotate in the same direction as the orbital direction of the conveyance belt 67 in the contact surface facing the conveyance belt 67 while making contact with the conveyance belt 67. At the time of transfer, due to a predetermined voltage applied from a not-shown power supply, a suitable transfer bias is applied between the transfer roller 68 and the photbconductor drum 56 by constant current control in such a direction that a toner image carried on the photoconductor drum 56 is shifted (transferred) onto the recording sheet 3.

The fixation portion 18 is disposed at the rear of the image forming units 16 and the transfer portion 17 and on the downstream side. The fixation portion 18 has a heating roller 70 and a pressure roller 69. The heating roller 70 is comprised of a metal base pipe having a mold release layer formed in its surface, and a halogen lamp is packed inside the metal base pipe along the axial direction of the metal base pipe. Due to the halogen lamp, the surface of the heating roller 70 is heated to a fixing temperature. On the other hand, the pressure roller 69 is disposed to press the heating roller 70.

A pair of sheet ejection rollers 11 are disposed on the downstream side of the fixation portion 18. A sheet ejection tray 10 is disposed on the downstream side of the sheet ejection rollers 11.

In the color laser printer 1 configured thus according to the embodiment, the surface of the photoconductor drum 56 is charged uniformly by the charger 21. The charged photoconductor drum 56 is irradiated with a laser beam (shown by the chain line in FIG. 1) modulated in accordance with image information by the scanner unit 19. Then, an electrostatic latent image is formed in the surface of the photoconductor drum 56. The electrostatic latent image is visualized with toner on the photoconductor drum 56 by the developing unit 20, and conveyed to a transfer position by the rotation of the photoconductor drum 56.

In the transfer position, a recording sheet 3 is supplied through the sheet feeding roller 13 and the conveyance rollers 14. The visualized image is transferred onto the recording sheet 3 by a transfer bias voltage applied by the transfer roller 68.

Next, the recording sheet 3 is conveyed to the fixation portion 18 while being put between the heating roller 70 and the pressure roller 69 of the fixation portion 18. Thus, the visualized image on the recording sheet 3 is heated and pressed to be fixed on the recording sheet 3. The recording sheet 3 is ejected to the sheet ejection tray 10 on the top of the color laser printer 1 by the sheet ejection rollers 11. Then, the image formation operation is terminated.

Figure 2:
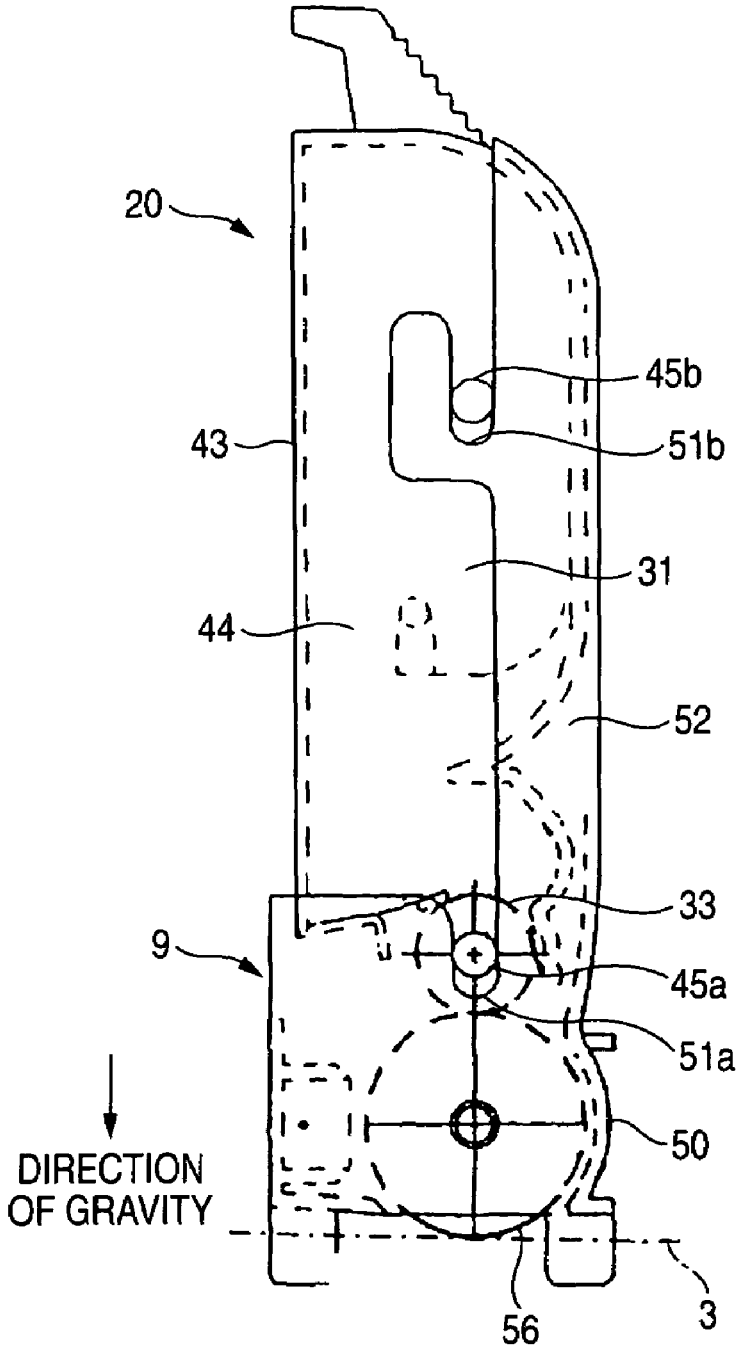
FIG. 2 is an explanatory view showing an embodiment in which a developing unit 20 is supported substantially in the direction of gravity.

Each image forming unit 16 of the color laser printer 1 according to the embodiment does not have a structure in which the developing roller 33 is brought into contact with the photoconductor drum 56 by a pressure mechanism using a spring as in the background art. In the image forming unit 16 according to the embodiment, the developing roller 33 provided at the lower end of the developing unit 20 is designed to come into contact with the photoconductor drum 56 only by the weight of the developing unit 20 itself. With reference to FIG. 2, detailed description will be made about how the developing roller 33 comes into contact with the photoconductor drum 56 only by the weight of the developing unit 20 itself.

As shown in FIG. 2, the developing unit 20 is supported on the photoconductor drum unit 9 so as to be fitted thereto.

The developing unit 20 has the developer casing 43 and the developing roller 33 supported on the lower end portion of the developer casing 43.

The developer casing 43 has a profile formed into a long shape when it is observed from a direction along the axis of rotation of the developing roller 33. The developer casing 43 supports the axis of rotation of the developing roller 33 in the inner surface portion of the long shape at a longitudinally lower end of a side plate 44 thereof so that the developing roller 33 can rotate freely. A protrusion 45*a* is provided at a position on an extensional line of the axis of the developing roller 33, and at an outer surface portion opposed to the portion of the lower end inner surface of the side plate 44 where the developing roller 33 is supported (in other words, the central portion of rotation of the developing roller) On the other hand, a protrusion 45*b* is provided in a portion of the outer surface of the side plate 44 and on a straight line connecting the center of rotation of the photoconductor drum 56 and the central portion of the developing roller 33.

In the present embodiment, the protrusion 45*a* is provided at a position on the extensional line of the axis of the developing roller 33. However, the position to provide the protrusion 45*a* is not limited to the above configuration, and the protrusion 45*a* may be provided at arbitrary position.

The developing unit 20 may be configured that the axis of the developing roller 33 is formed to protrude outward from the side plate 44 to serve as the protrusion 45*a*, instead of providing the protrusion 45*a*.

The photoconductor unit 9 includes the photoconductor drum 56 and a photoconductor drum casing 50 including the photoconductor drum 56.

The photoconductor drum casing 50 has a profile formed into a long shape when it is observed from a direction along the axis of rotation of the photoconductor drum 56. The photoconductor drum casing 50 supports the photoconductor drum 56 in the inner surface portion of the long shape in the longitudinally lower end of a side plate 52 thereof so that the photoconductor drum 56 can rotate freely.

The photoconductor drum casing 50 is also provided with guides 51*a* and 51*b* for supporting the developing unit 20.

Each guide 51*a*, 51*b* is formed by notching the side plate 52 of the photoconductor drum casing 50 partially into a U-shape on a straight line (hereinafter referred to as "guide line") connecting the contact point between the photoconductor drum 56 and the developing roller 33 and the center of rotation of the developing roller 33 when the guide 51*a*, 51*b* is observed from a direction along the axis of rotation of the photoconductor drum 56.

In the present embodiment, the guides 51*a* and 51*b* that guide the protrusions 45*a* and 45*b* are provided on the photoconductor drum casing 50. However, the protrusions 45*a* and 45*b* may be configured to be guided by the body casing 2 instead of the photoconductor drum casing 50, by providing the guides 51*a* and 51*b* on the body casing 2 with shapes thereof being formed to be substantially the same with the present embodiment.

The protrusions 45*a* and 45*b* of the developing unit 20 (specifically, provided in the side plate 44) are inserted into the guides 51*a* and 51*b* respectively. Thus, the developing unit 20 is supported on the photoconductor unit 9 so as to be displaceable in the guide line direction.

In order to support the developing unit 20 displaceable in the guide line direction in such a manner, the guide 51*a*, 51*b* is notched into a U-shape so that the protrusion 45*a*, 45*b* inserted thereto can be displaced in the longitudinal direction of the notch of the guide 51*a*, 51*b* but cannot be displaced in the transverse direction.

The protrusions 45*a* and 45*b* are, in particular in the embodiment, formed in a substantially cylindrical shape having a diameter substantially the same with the width (in the transverse direction) of the guides 51*a* and 51*b*, respectively. Accordingly, the protrusions 45*a* and 45*b* cannot be displaced in the transverse direction.

The U-shape notches of the guides 51*a* and 51*b* are cut to be sufficiently deep so that the developing roller 33 provided at the lower end of the developing unit 20 can be displaced to a position where the developing roller 33 can abut against the photoconductor drum 56. The photoconductor unit 9 (specifically, the photoconductor drum casing 50) is formed into a shape such that the guide line extends substantially in the direction of gravity.

As a result, the developing unit 20 can be displaced in the longitudinal direction of the notches of the guides 51*a* and 51*b* in the state where the developing unit 20 is fitted to the photoconductor unit 9. The developing roller 33 provided at the lower end of the developing unit 20 is brought into contact with the photoconductor drum 56 by the weight of the developing unit 20 itself so that the toner received in the toner hopper 31 can be transferred to the photoconductor drum 56.

In such a manner, due to the guides 51*a* and 51*b* according to the embodiment, a pressure mechanism or a release mechanism is dispensable. Thus, the image forming unit 16 can be simplified in structure, and miniaturized.

The weight of the developing unit 20 can be made to act efficiently as a contact force on the photoconductor drum 56 due to the arrangement of the developing unit 20 being brought into contact with an upper portion of the photoconductor drum 56. Thus, a necessary and sufficient contact pressure can be obtained easily.

In the first embodiment, the developing unit 20 has a sectional shape of a longitudinal shape in view from a direction in which the displacement of the contact portion relative to the surface of the photoconductor drum 56 and the displacement of the developing unit 20 along the predetermined direction can be both observed. And, the contact portion is provided at one end of a longitudinal direction of the sectional shape of the developing unit 20, and the guides 51*a* and 51*b* supports the developing unit 20 to be displaceable in the longitudinal direction of the sectional shape of the developing unit 20.

With this configuration, the developing unit 20 can be put in or out in the longitudinal direction of the developing unit 20 when the developing unit 20 is to be attached to or removed from the color laser printer 1. Thus, the attachment/removal operation becomes easy. In addition, when a plurality of developing units 20 are included in the color laser printer 1, the developing units 20 can be arranged in parallel without providing any additional space. Thus, the volume efficiency of the color laser printer 1 is improved so that the color laser printer 1 can be miniaturized.

With increase in the cumulative number of printed sheets, the toner received in the developing unit 20 is reduced so that the weight of the developing unit 20 itself is reduced. Thus, the contact pressure between the developing roller 33 and the photoconductor drum 56 is reduced gradually.

Accordingly, with increase in the cumulative number of printed sheets, the load on the developing roller 33 and the photoconductor drum 56 is lightened. Thus, the life of the developing roller 33, the photoconductor drum 56 or the toner can be extended.

Although the first embodiment of the invention has been described above, the invention is not limited to the first embodiment.

Figure 3:
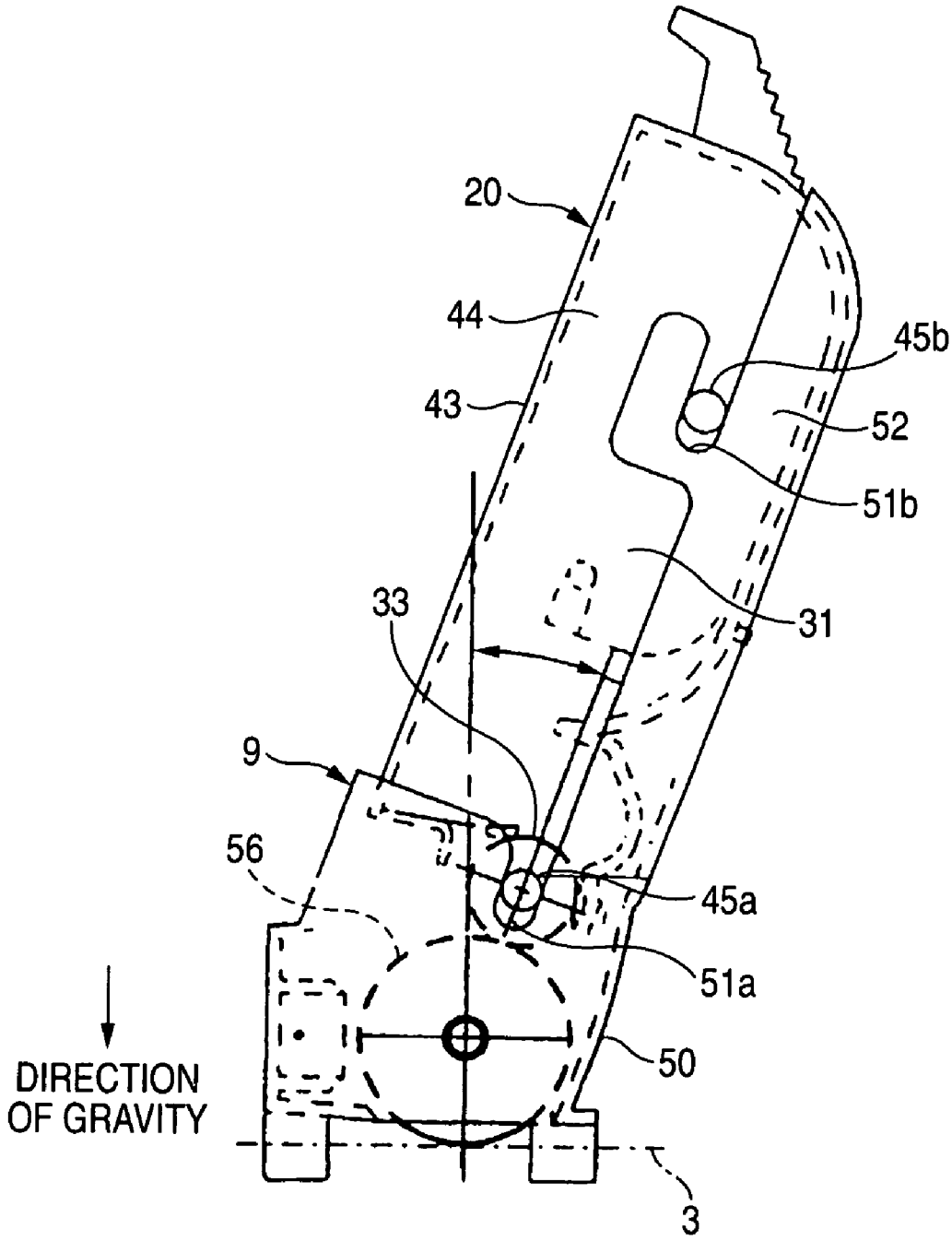
FIG. 3 is an explanatory view showing an embodiment in which the developing unit 20 is supported while being inclined.

For example, in the first embodiment, the photoconductor unit 9 is formed so that the guide line extends substantially in the direction of gravity. However, as shown in FIG. 3 as a second embodiment, the photoconductor unit 9 (specifically, the photoconductor drum casing 50) may be formed so that the guide line extends in an angle range of ±45 degrees with respect to the direction of gravity. In this case, the weight of the developing unit 20 itself is applied to the photoconductor drum 56 so that it is possible to secure a contact pressure required for transferring the toner from the developing roller 33 to the photoconductor drum 56.

It is also preferable to provide the guides 51*a* and 51*b* to support the developing unit 20 to be displaceable in a direction substantially the same with the direction of gravity. In this configuration, the weight of the developing unit 20 is applied onto the photoconductor drum 56 most efficiently. Thus, the developing unit 20 can be made small in size and light in weight, and hence the color laser printer 1 can be made small in size and light in weight.

Figure 4:
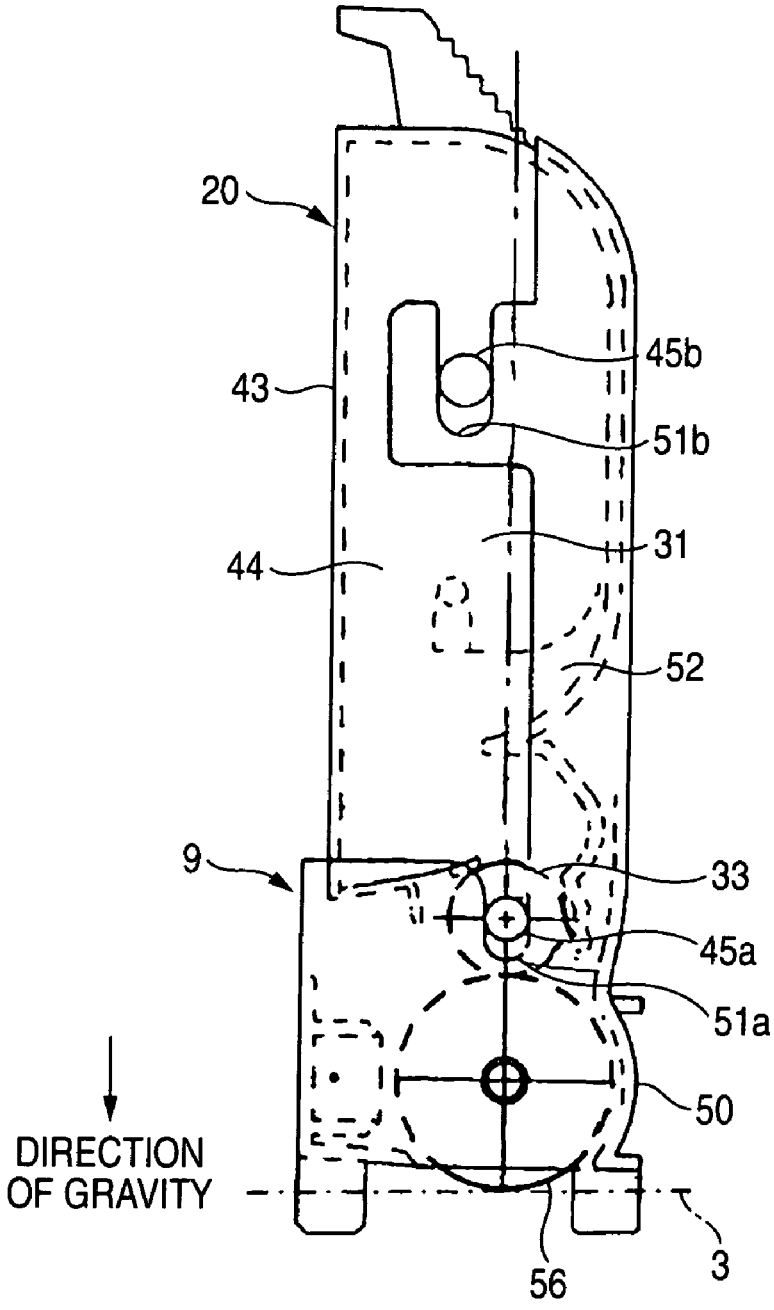
FIG. 4 is an explanatory view showing the state where the positions of guides shown in FIG. 2 are displaced in parallel.

Although the positions of the guides 51*a* and 51*b* are set on the guide line in the first embodiment, the position of the guide 51*b* may be located out of the guide line so that the direction of the notch of the guide 51*b* is parallel to the guide line as shown in FIG. 4 as a third embodiment. In the third embodiment, the required contact pressure can be secured.

With a configuration of the third embodiment, the weight of the developing unit 20 itself is applied to the photoconductor drum 56 most efficiently. Accordingly, the developing unit 20 can be made small in size and light in weight, and hence the image forming unit 16 can be made small in size and light in weight.

Figure 5:
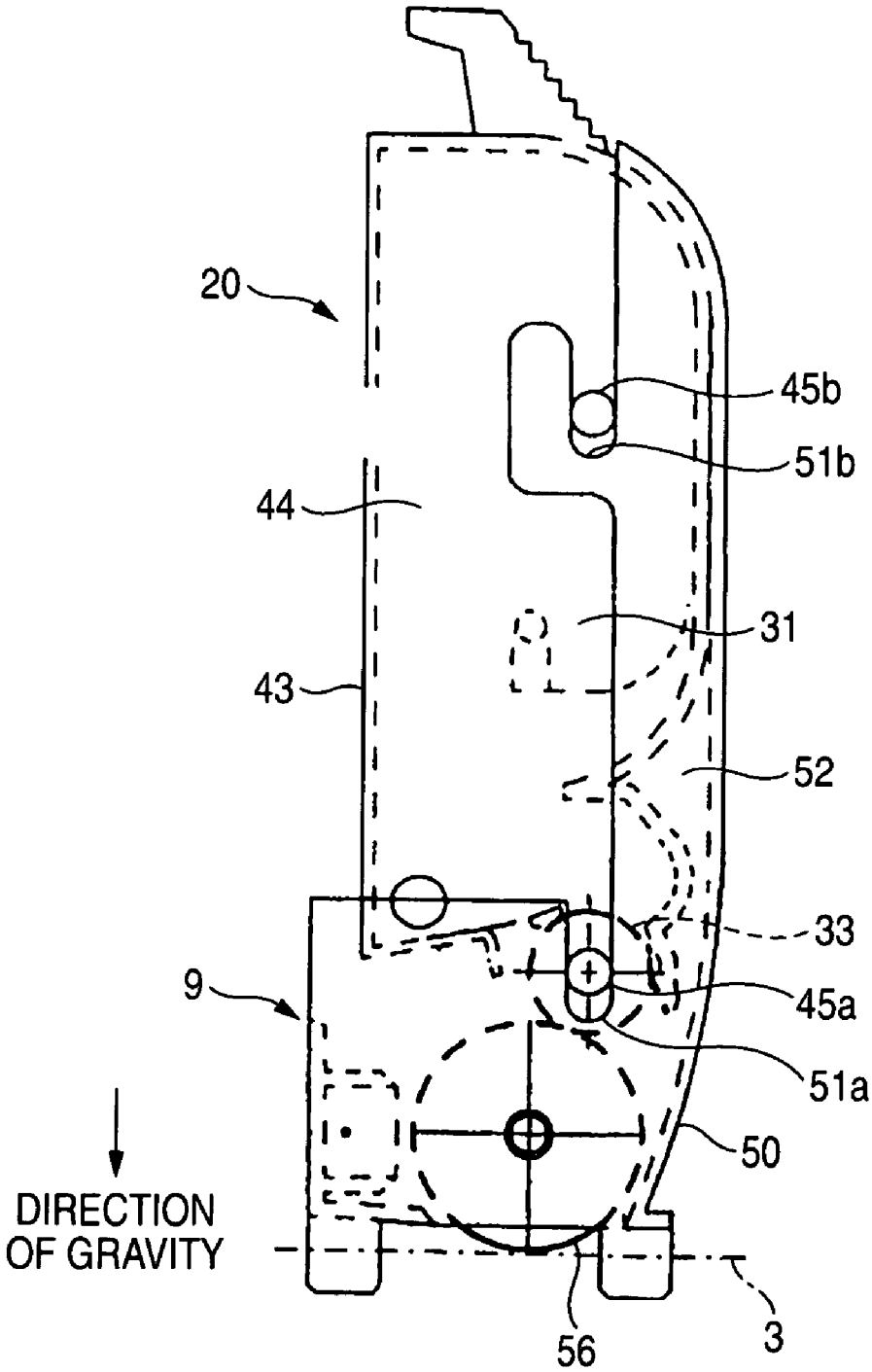
FIG. 5 is an explanatory view showing the state where the directions of notches of the guides shown in FIG. 4 are changed.

Alternatively, as shown in FIG. 5 as a fourth embodiment, the longitudinal direction of the notch of each guide 51*a*, 51*b* (i.e. the direction in which the developing unit 20 is guided) may be set in the direction of gravity while the guide line is inclined within an angle range of ±45 degrees with respect to the direction of gravity. In the fourth embodiment, the required contact pressure can be secured.

Further, though not shown particularly, the guide line may be made to extend in the direction of gravity while the longitudinal direction of the notch of each guide 51*a*, 51*b* (i.e. the direction in which the developing unit 20 is guided) is inclined within an angle range of ±45 degrees with respect to the direction of gravity. Also in this case, the required contact pressure can be secured.

Figure 6:
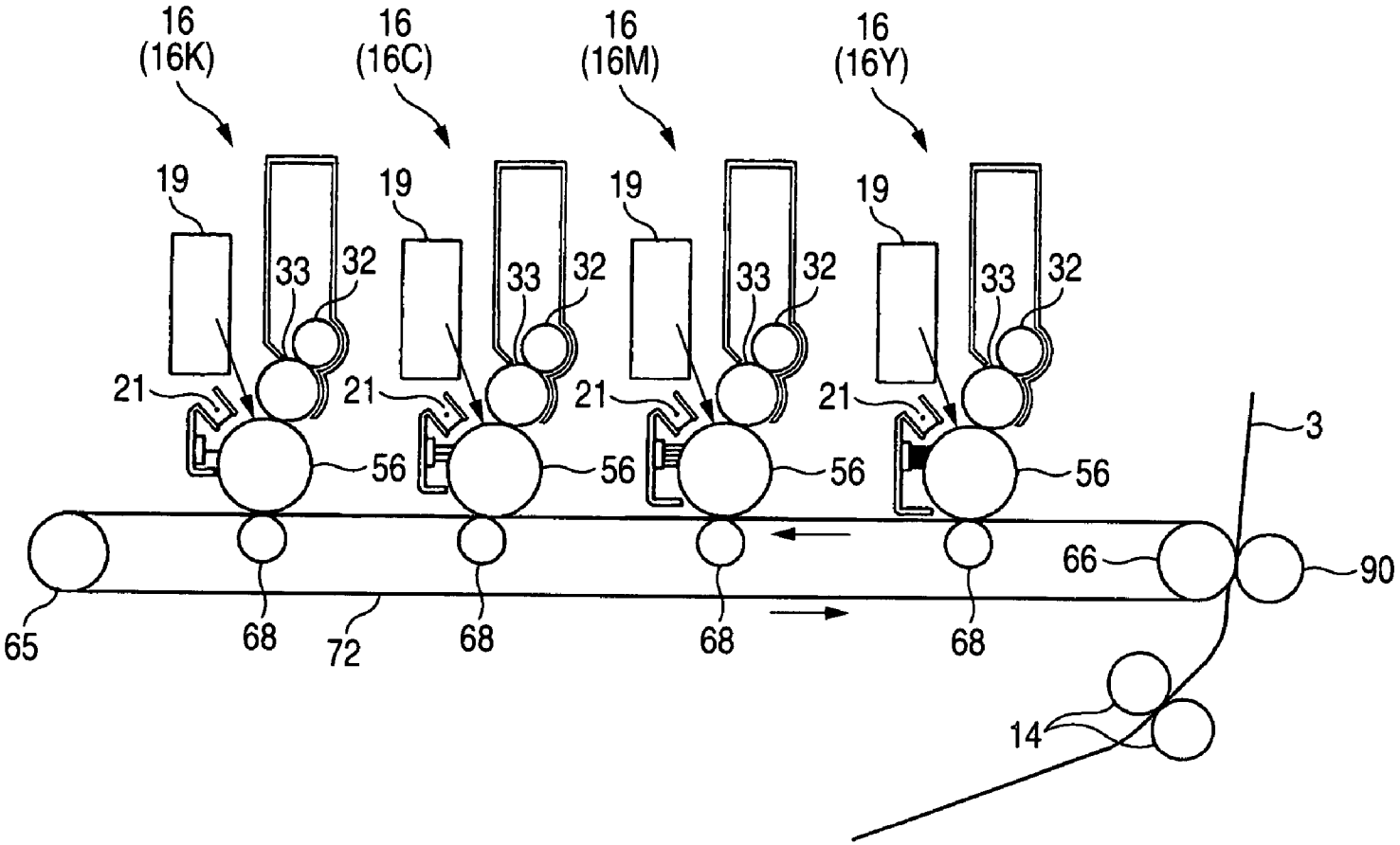
FIG. 6 is an explanatory view showing the schematic configuration of a color laser printer using an intermediate transfer belt to form an image on a recording sheet.

The embodiments has been described about the color laser printer 1 of a system in which toner images on the photoconductor drums 56 are transferred directly from the photoconductor drums 56 to the recording sheet 3 conveyed on the conveyance belt 67 so as to form a color image. However, as shown in FIG. 6 as a fifth embodiment, the invention may be applied to a color laser printer 1 in which toner images are transferred sequentially onto an intermediate transfer belt 72 so as to form a color image on the intermediate transfer belt 72 once, and the color image is then secondarily transferred to the recording sheet 3 by a secondary transfer roller 90. In the fifth embodiment, the advantages similar to the first to the fourth embodiments can also be obtained.

The embodiments have been described about the case where the invention is applied to the color laser printer 1. However, the invention is applicable to any image forming apparatus that uses toner. The image forming apparatus is not limited to the color laser printer 1, but may be applied to, for example, a so-called LED printer in which exposure is performed by LEDs (light emitting diodes). Alternatively, the invention may be applied to a copying machine or a facsimile machine. In such a case, the advantages similar to the first to the fifth embodiments can also be obtained.

From the viewpoint of preventing deterioration of the photoconductor drum 56 due to abrasion, it is preferable that a roller (developing roller 33) having its surface rotating while making contact with the photoconductor drum 56 surface is used as the contact portion of the developing unit 20 for coming in contact with the photoconductor drum 56.

In the case where the roller is used thus as the contact portion, the guides 51*a* and 51*b* may support the developing unit 20 so that the developing unit 20 is displaced along a line connecting a contact point between the roller (developing roller 33) and the photoconductor drum 56 with a center of rotation of the roller when the guides 51*a* and 51*b* is observed in a direction along an axis of rotation of the roller.

With this configuration, the roller is put on the top of the photoconductor drum 56 so that the weight of the developing unit 20 itself is applied onto the photoconductor drum 56 through the roller. Thus, the contact pressure of the roller onto the photoconductor drum 56 can be secured.

Alternatively, in the case where the roller is used as the contact portion, the guides 51*a* and 51*b* may support the developing unit 20 so that a slant of a line connecting a contact point between the roller and the photoconductor drum 56 with a center of rotation of the roller is in an angle range of ±45 degrees with respect to a direction of gravity when the guides 51*a* and 51*b* are observed in a direction along an axis of rotation of the roller.

With this configuration, the weight of the developing unit 20 itself is applied onto the photoconductor drum 56 through the roller. Thus, the contact pressure of the roller onto the image carrier 20 can be secured.

Particularly, the guides 51*a* and 51*b* may be configured to support the developing unit 20 so that the line connecting the contact point between the roller and the photoconductor drum 56 with the center of rotation of the roller extends substantially in the direction of gravity when the guides 51*a* and 51*b* are observed in the direction along the axis of rotation of the roller. In this case, the weight of the developing unit 20 itself is applied onto the photoconductor drum 56 most efficiently through the roller. Thus, the developing unit 20 can be made small in size and light in weight, and hence the image forming apparatus can be made small in size and light in weight.

The developing unit 20 may be configured to be removably attached to the color laser printer 1 through the guides 51*a* and 51*b*. In this case, the developing unit 20 can be attached and removed easily. In addition, at the time of maintenance, the photoconductor drum 56 and the developing unit 20 can be replaced independently. Thus, the maintenance cost can be reduced.

In the embodiment, an image carrier is not limited to be configured as the photoconductor drum 56, and arbitrary image carrier may be used if it can carry an electrostatic latent image or a toner image in accordance with an image formation step. A plate-shaped image carrier or a drum-shaped image carrier may also be used. However, it is preferable to configure the image carrier with a rotary drum (photoconductor drum 56 in the embodiments described above) that is provided to be rotatable, and to configure the electrostatic latent image and the toner image to be formed sequentially on an outer circumferential surface of the rotary drum in synchronization with rotation of the rotary drum. In this configuration, a large image can be formed seamlessly. Thus, it is possible to miniaturize the color laser printer 1 that can form a large image.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application program to enable one skilled in the art to utilize the invention in various embodiments and with various modifications as are suited to the particular use contemplated. It is intended that the scope of the invention be defined by the claims appended hereto, and their equivalents.

What is claimed is:

1. An image forming apparatus comprising:

an image carrier that carries an electrostatic latent image thereon;

an electrostatic latent image forming unit that forms an electrostatic latent image on a surface of the image carrier;

a developing unit comprising:

a developer casing having a pair of side plates that oppose with each other and receives developer therein;

a developing roller that carries the developer and supplies the developer to an image carrier, the developing roller being rotatably supported by an axis thereof that is supported by the side plates; and at least two protrusions being protruded from the side plates, at least one of the two protrusions is provided on an extensional line that passes an abutting portion where the developing roller and the image carrier abut with each other, and a rotational axis of the axis that supports the developing roller;

wherein the developing unit is provided with two protrusions of a first protrusion and a second protrusion;

wherein the first protrusion is provided on the extensional line; and wherein a distance between the abutting portion and the second protrusion is configured to be larger than a distance between the abutting portion and the first protrusion, and a guide mechanism that supports the developing unit to be displaceable in a predetermined direction so as to bring the contact portion of the developing unit into contact with an upper portion of the image carrier due to a weight of the developing unit.

2. The image forming apparatus according to claim 1, wherein the developing unit has a sectional shape of a longitudinal shape in view from a direction in which the displacement of the contact portion relative to the surface of the image carrier and the displacement of the developing unit along the predetermined direction can be both observed, wherein the contact portion is provided at one end of a longitudinal direction of the sectional shape of the developing unit, and wherein the guide mechanism supports the developing unit to be displaceable in the longitudinal direction of the sectional shape of the developing unit.

3. The image forming apparatus according to claim 1, wherein the guide mechanism supports the developing unit to be displaceable in a direction within an angle range of ±45 degrees with respect to a direction of gravity.

4. The image forming apparatus according to claim 3, wherein the guide mechanism supports the developing unit to be displaceable in a direction substantially the same with the direction of gravity.

5. The image forming apparatus according to claim 1, wherein the developing unit has a roller that serves the contact portion, the roller having a roller surface rotating while contacting with the surface of the image carrier, and wherein the guide mechanism supports the developing unit to be displaceable in a direction along a line connecting a contact point between the roller and the image carrier with a center of rotation of the roller when the guide mechanism is observed in a direction along an axis of rotation of the roller.

6. The image forming apparatus according to claim 1, wherein the developing unit has a roller that serves the contact portion, the roller having a roller surface rotating while contacting with the surface of the image carrier, and wherein the guide mechanism supports the developing unit so that a slant of a line connecting a contact point between the roller and the surface of the image carrier with a center of rotation of the roller falls in an angle range of ±45 degrees with respect to a direction of gravity when the guide mechanism is observed in a direction along an axis of rotation of the roller.

7. The image forming apparatus according to claim 6, wherein the guide mechanism supports the developing unit so that the line connecting the contact point with the center of rotation of the roller extends substantially the same with the direction of gravity when the guide mechanism is observed in the direction along the axis of rotation of the roller.

8. The image forming apparatus according to claim 1, wherein the developing unit is removably attached to the image forming apparatus through the guide mechanism.

9. The image forming apparatus according to claim 1, wherein the image carrier includes a rotary drum that is provided to be rotatable, and wherein the electrostatic latent image and the toner image are formed sequentially on an outer circumferential surface of the rotary drum in synchronization with rotation of the rotary drum.

10. The image forming apparatus according to claim 1, wherein a plurality of image forming units each provided with the image carrier, the electrostatic latent image forming unit, the developing unit and the guide mechanism, and wherein each of the toner hopper of the respective image forming units receives the toner different in color from the toner received in the toner hopper in the other image forming unit.

11. A developing unit comprising:

a developer casing having a pair of side plates that oppose with each other and receives developer therein;

a developing roller that carries the developer and supplies the developer to an image carrier, the developing roller being rotatably supported by an axis thereof that is supported by the side plates; and at least two protrusions being protruded from the side plates, at least one of the two protrusions is provided on an extensional line that passes an abutting portion where the developing roller and the image carrier abut with each other, and a rotational axis of the axis that supports the developing roller;

wherein the developing unit is provided with two protrusions of a first protrusion and a second protrusion, wherein the first protrusion is provided on the extensional line, and wherein a distance between the abutting portion and the second protrusion is configured to be lager than a distance between the abutting portion and the first protrusion.

12. The developing unit according to claim 11, wherein the first protrusion is the axis of the developing roller.

13. The developing unit according to claim 11, wherein the other one of the two protrusions is provided on an extensional line that is parallel to a line that passes the abutting portion and the rotational axis of the axis of the developing roller.

14. The developing unit according to claim 13, wherein the developing unit is provided with two protrusions of a first protrusion and a second protrusion, and wherein the first protrusion is provided on the extensional line.

15. The developing unit according to claim 14, wherein the first protrusion is the axis of the developing roller.

16. A photoconductor unit comprising:

a photoconductor drum casing having a pair of side plates that rotatably support a image carrier, the photoconductor drum casing to which a developing unit having a developing roller is detachably attached; and at least two guides formed by notching the side plates partially into a U-shape, at least one of the two guides is provided on an extensional line that passes an abutting portion where the developing roller and the image carrier abut with each other, and a rotational axis of the axis that supports the developing roller;

wherein the photoconductor unit is provided with two guides of a first guide and a second guide, wherein the first guide is provided on the extensional line, and wherein a distance between the abutting portion and the second guide is configured to be larger than a distance between the abutting portion and the first guide.

17. A process unit comprising:

a developing unit that includes:

a developer casing having a pair of side plates that oppose with each other and receives developer therein;

a developing roller that carries the developer and supplies the developer to an image carrier, the developing roller being rotatably supported by an axis thereof that is supported by the side plates; and at least two protrusions being protruded from the side plates; and a photoconductor unit that includes:

a photoconductor drum casing having a pair of side plates that rotatably support a image carrier, the photoconductor drum casing to which a developing unit having a developing roller is detachably attached; and at least two guides formed by notching the side plates partially into a U-shape, the guides respectively supporting the protrusions;

wherein at least one of the two protrusions and the respective one of the two guides are provided on an extensional line that passes an abutting portion where the developing roller and the image carrier abut with each other, and a rotational axis of the axis that supports the developing roller;

wherein the process unit is provided with two protrusions of a first protrusion and a second protrusion, wherein the process unit is provided with two guides of a first guide and a second guide, wherein the first protrusion and the first guide is provided on the extensional line, and wherein a distance between the abutting portion and the second protrusion is configured to be larger than a distance between the abutting portion and the first protrusion.

18. The process unit according to claim 17, wherein the first protrusion is the axis of the developing roller.

19. The process unit according to claim 17, wherein the other one of the two protrusions and the other one of the two guides are provided on an extensional line that is parallel to a line that passes the abutting portion and the rotational axis of the axis of the developing roller.

20. The process unit according to claim 19, wherein the developing unit is provided with two protrusions of a first protrusion and a second protrusion, and wherein the first protrusion is provided on the extensional line.

21. The process unit according to claim 20, wherein the first protrusion is the axis of the developing roller.

* * * * *